US009638100B2

(12) United States Patent
Telahigue

(10) Patent No.: US 9,638,100 B2
(45) Date of Patent: May 2, 2017

(54) ENGINE

(71) Applicant: Mabrouk Telahigue, Vancouver (CA)

(72) Inventor: Mabrouk Telahigue, Vancouver (CA)

( * ) Notice: Subject to any disclaimer, the term of this patent is extended or adjusted under 35 U.S.C. 154(b) by 159 days.

(21) Appl. No.: 14/689,001

(22) Filed: Apr. 16, 2015

(65) Prior Publication Data

US 2016/0305317 A1 Oct. 20, 2016

(51) Int. Cl.

| | |
|---|---|
| ***F02B 75/28*** | (2006.01) |
| ***F04B 9/02*** | (2006.01) |
| ***F04B 17/05*** | (2006.01) |
| ***F04B 11/00*** | (2006.01) |
| ***F01B 23/08*** | (2006.01) |
| ***F02B 71/04*** | (2006.01) |
| ***F01B 11/00*** | (2006.01) |
| *F02M 59/44* | (2006.01) |
| *F02B 75/30* | (2006.01) |
| *F02B 75/40* | (2006.01) |
| *F02B 63/06* | (2006.01) |

(52) U.S. Cl.

CPC ..... *F02B 75/28* (2013.01); *F01B 11/004* (2013.01); *F01B 23/08* (2013.01); *F02B 71/04* (2013.01); *F04B 9/02* (2013.01); *F04B 11/0008* (2013.01); *F04B 17/05* (2013.01); *F02B 63/06* (2013.01); *F02B 75/30* (2013.01); *F02B 75/40* (2013.01); *F02M 59/44* (2013.01)

(58) Field of Classification Search

CPC ..... F02B 75/28; F02B 75/32; F02B 75/40; F02M 59/44

USPC ..... 123/445, 46 R, 46 A

See application file for complete search history.

(56) References Cited

U.S. PATENT DOCUMENTS

| | | | | |
|---|---|---|---|---|
| 113,839 | A | 4/1871 | Bennison | |
| 1,866,022 | A | 7/1932 | Findeisen | |
| 2,274,683 | A | 5/1939 | Fraser | |
| 2,678,032 | A * | 5/1954 | Mallory | F02B 71/00 123/46 R |
| 3,174,432 | A * | 3/1965 | Eickmann | F02B 71/045 417/206 |
| 4,014,392 | A * | 3/1977 | Ross | B25D 11/125 173/117 |
| 4,425,880 | A | 1/1984 | Rochlus | |
| 6,047,592 | A | 4/2000 | Wirth et al. | |
| 6,487,858 | B2 | 12/2002 | Cammack | |
| 6,871,497 | B2 | 3/2005 | Isogai | |
| 8,161,936 | B2 | 4/2012 | Kraft et al. | |

(Continued)

FOREIGN PATENT DOCUMENTS

| | | |
|---|---|---|
| CA | 1214995 | 12/1986 |
| CA | 2297393 A1 | 2/2001 |

(Continued)

*Primary Examiner* — Mahmoud Gimie

(57) ABSTRACT

An engine can include at least one piston, a block, a fluid delivery system, and an output shaft. The block can define at least one cylinder. The piston can be received in the cylinder. The piston can be operable to reciprocally move rectilinearly while positioned in the cylinder. The fluid delivery system can be operable to communicate air and combustible fuel to the cylinder. The piston can be operable to compress the air and combustible fuel. The output shaft can be driven in motion by the piston and extend beyond the block to a distal end. The output shaft is limited to rectilinear movement.

10 Claims, 7 Drawing Sheets

(56) References Cited

U.S. PATENT DOCUMENTS

2008/0251050 A1* 10/2008 Jacobsen ..... F01L 9/04
123/46 R

FOREIGN PATENT DOCUMENTS

DE 102010025871 A1 2/2010
EP 0064563 5/1981

* cited by examiner

ENGINE

BACKGROUND

1. Field

The present disclosure relates to an engine.

2. Description of Related Prior Art

U.S. Pat. No. 1,866,022 discloses a FOUR-STOKE INTERNAL COMBUSTION ENGINE. The '022 patent issued on Jul. 5, 1932. The four-stroke internal combustion engine comprises in combination four pistons travelling in corresponding cylinders, an H-shaped connecting member for securing the pistons to its free ends, slidable blocks arranged on extensions of the cross pin at both sides of the H-shaped connecting member for supporting the latter on the casing wall, and a connecting rod connected to the said cross pin.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

An engine can include at least one piston, a block, a fluid delivery system, and an output shaft. The block can define at least one cylinder. The piston can be received in the cylinder. The piston can be operable to reciprocally move rectilinearly while positioned in the cylinder. The fluid delivery system can be operable to communicate air and combustible fuel to the cylinder. The piston can be operable to compress the air and combustible fuel. The output shaft can be driven in motion by the piston and extend beyond the block to a distal end. The output shaft is limited to rectilinear movement.

BRIEF DESCRIPTION OF THE DRAWINGS

The detailed description set forth below references the following drawings.

DETAILED DESCRIPTION

Figure 1:
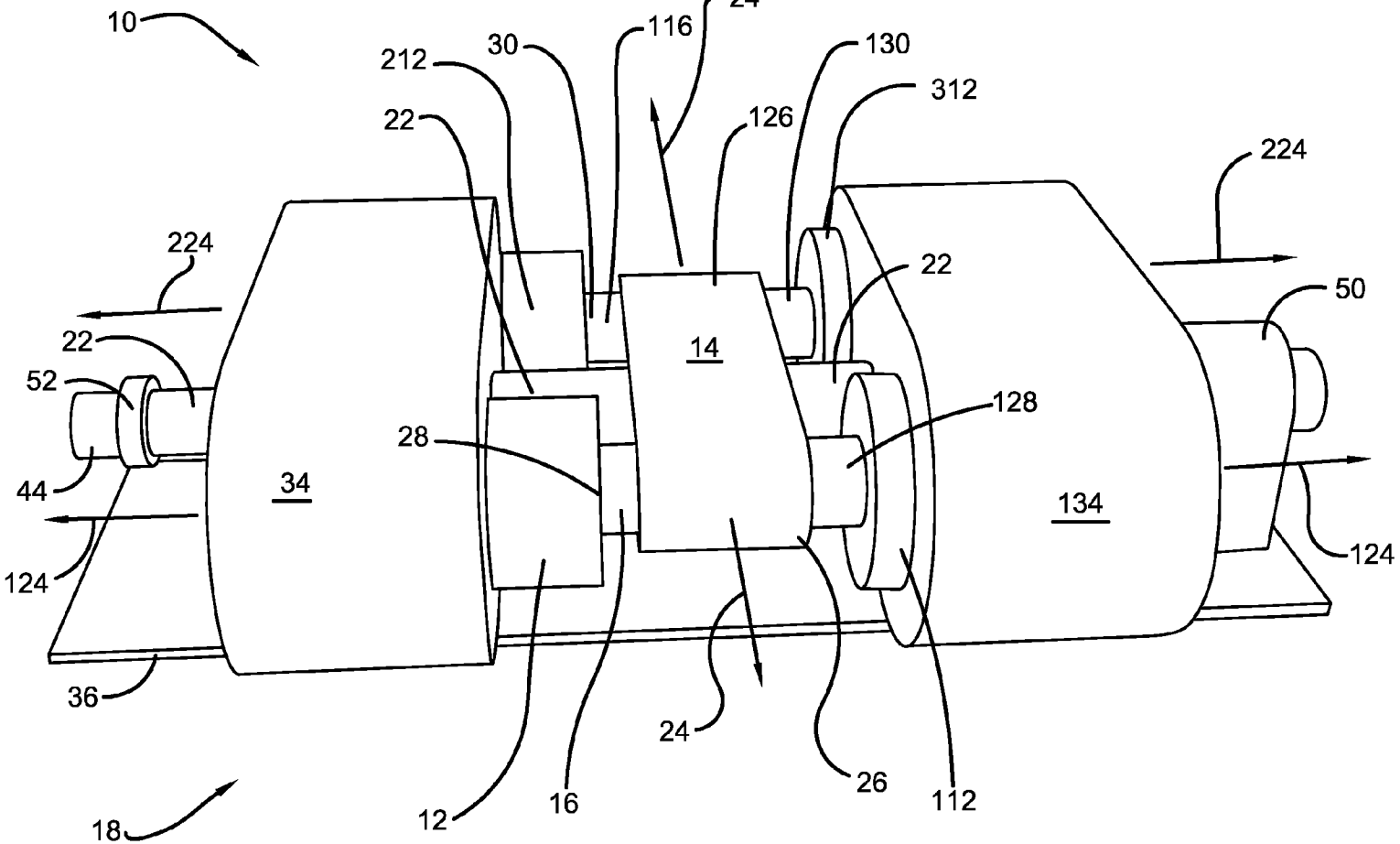
FIG. 1 is a first perspective view of an engine according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiments described below, can provide an engine, a device with moving parts that converts power into motion. A first exemplary embodiment of the present disclosure relates to a four stroke engine with an arrangement of pistons operating in a dual block. This arrangement obviates the need for a crank and cam shaft; electric valves can be used to allow fuel and air to pass into cylinders in the block and allow exhaust to pass out of the cylinders. Hydraulic or electronic operated valves can be applied. The weight size and fuel consumption of the first exemplary embodiment are considerably reduced relative to traditional engines, resulting in an extremely efficient engine for vehicles and the like.

In a first exemplary embodiment, various links are assembled to form a double-ended fork with the central branch extending on both ends. Four engine pistons are attached back-to-back to outer branches of two of the links. Two hydraulic pistons are fastened a central link. The link located at the center of the assembly can serve as a guide for the power pistons and drives the hydraulic pumps positioned at each side of engine blocks. The entire assembly (structure and pistons) can move freely back and forth in a linear motion when the engine pistons slide inside their respective cylinders. The cylinders can be defined by two engine sub-blocks attached together with a space in-between (for the assembly to move in) with the engine heads at each external end.

The engine according to the first exemplary embodiment of the present disclosure delivers work through rectilinear motion. Four engine pistons can be attached back-to-back to the short ends of a rigid double-ended fork structure (one at each end). An output shaft can be mounted at the center of the structure in a longitudinal plane and extend at both ends. The output shaft can be located at the center of the assembly and can serve as a guide for the power pistons. The output shaft can also drive a double acting hydraulic pump. The entire assembly can move freely back and forth in rectilinear motion when the engine pistons slide inside their respective cylinders.

The configuration of the first exemplary embodiment allows the piston on the power stroke to do work on the hydraulic pump and at the same time move the three other pistons in order to start their next cycle (as in a four stroke engine). All of this can be accomplished without any crankshaft, connecting rods or gears. The structure could slide flat into a horizontal or a vertical plane.

Because all four pistons can be moving together in one direction and the engine heads are opposed, the engine can work like a conventional four strokes internal combustion engine in terms of timing of firing cycle. When the group piston assembly is set in motion by a starter, and when one of the cylinders reaches the compression cycle, the fuel mixture is ignited and the assembly is pushed in one direction allowing the three others pistons to start their respective next cycle. The opposite cylinder will be in compression, the adjacent in intake and the opposite diagonally in exhaust cycle. The process will continue hence at any time there is one cylinder in the combustion cycle. The pistons can't hit the engine heads because of the compression in the opposite cylinder and the remaining oil in the hydraulic pump cylinder. Also it's easy to control the engine pistons speed by restricting the oil flow. Any number of piston quartets could be engaged together to increase the output power as desired.

The hydraulic pump double acting pistons could have the same or different diameter and their respective seize is determined by the delivery rate and the pressure needed.

The first exemplary embodiment is an efficient engine because the load is in line with the motion of the pistons, most of the energy is converted to work. The first exemplary embodiment is durable, quiet and reliable with a minimum of moving parts. The first exemplary embodiment is easy to maintain and inexpensive to build, having no crankshaft, connecting rod, camshaft, timing chain or gears. The output shaft can absorb side forces, so there is less friction on the pistons sides and rings. The first exemplary embodiment is compact in size and weight. Further, because the sleeves, pistons, valve seats and valves could be mounted from the bottom of the cylinder, the engine-head could be part of the engine block, so no heavy engine-head and gasket are needed.

A hydraulic (nitrogen or helium) accumulator can be applied to minimize the pump pulsations, absorb hydraulic shocks, dump vibrations and provide pressure compensation. The accumulator can also serve as a starter. Thus, no heavy battery is needed and only a relatively smaller alternator (coupled directly to a small hydraulic motor) could deliver the electric power as needed. A small hydraulic electric or hand pump can be added to charge the accumulator when it's discharged.

Embodiments of the present disclosure could be designed as a diesel engine or a gas engine. Various embodiments could run on a variety of fuel because it is easy to change the compression ratio by moving two half engine blocks closer together or further apart. An auxiliary small piston could be driven by the shaft to power an oil pump to lubricate the engine moving parts.

Embodiments of the present disclosure are suitable for numerous operating environments. By way of example and not limitation, embodiments could be applied in high torque hydraulic motors and hydraulic arms for powering excavating, mining and agriculture equipment, helicopters and the like; four wheel drive cars (hydraulic motor in each wheel and no transmission needed); hydraulic hammer and impact tools; linear generators and air compressors; water pumps; and engine accessories such as distributers, oil and fuel pumps, power steering and power-brakes. Because the engine is reliable, lightweight and compact, it's suitable to power drones (each propeller is driven by a hydraulic motor instead of electric motor). Because an embodiment of the engine can be so light and compact, an embodiment could be suitable for motorcycles and it's possible to have a two-wheel drive motorcycle by fitting a hydraulic motor in each wheel and avoid in the same time the use of chain and sprocket.

Referring now to FIGS. 1-4, an exemplary engine 10 includes a plurality of primary pistons 12, 112, 212, 312, a cross member 14, a first linking member 16, a second linking member 116, a block 18, a fluid delivery system 20 (referenced only in FIG. 4), and an output shaft 22. The plurality of primary pistons 12, 112, 212, 312 include a first primary piston 12 and a second primary piston 112 and a third primary piston 212 and a fourth primary piston 312. Embodiments of the present disclosure could include any number of primary pistons. The cross member 14 extends along a first axis 24 between a first distal end 26 and second distal end 126.

The first linking member 16 can be mounted to the cross member 14 at the first distal end 26. The first linking member 16 can extend along a second axis 124 between a third distal end 28 and a fourth distal end 128. The second axis 124 can be perpendicular to the first axis 24. The first primary piston 12 can be mounted on the third distal end 28 and the second primary piston 112 can be mounted on the fourth distal end 128.

The second linking member 116 can be mounted to the cross member 14 at the second distal end 126. The second linking member 116 can extend along a third axis 224 between a fifth distal end 30 and a sixth distal end 130. The third axis 224 can be perpendicular to the first axis 24. The third primary piston 212 can be mounted on the fifth distal end 30 and the fourth primary piston 312 can be mounted on the sixth distal end 130.

The block 18 and pistons 12, 112, 212, 312 can define an internal combustion or IC portion of the engine 10. The block 18 can define a first cylinder and a second cylinder and a third cylinder and a fourth cylinder. The first primary piston 12 can be received in the first cylinder. The second primary piston 112 can be received in the second cylinder. The third primary piston 212 can be received in the third cylinder. The fourth primary piston 312 can be received in the fourth cylinder. The first cylinder is referenced at 32 and the second cylinder is referenced at 132 in FIG. 6.

The pistons 12, 112, 212, 312 are operable to reciprocally move rectilinearly while positioned in the cylinders. The first primary piston 12 and the second primary piston 112 are operable to concurrently move in the same rectilinear direction along the axis 124 while respectively positioned in the first cylinder 32 and the second cylinder 132. The third primary piston 212 and the fourth primary piston 312 are operable to concurrently move in the same rectilinear direction along the axis 224 while respectively positioned in the third cylinder and the fourth cylinder.

Figure 6:
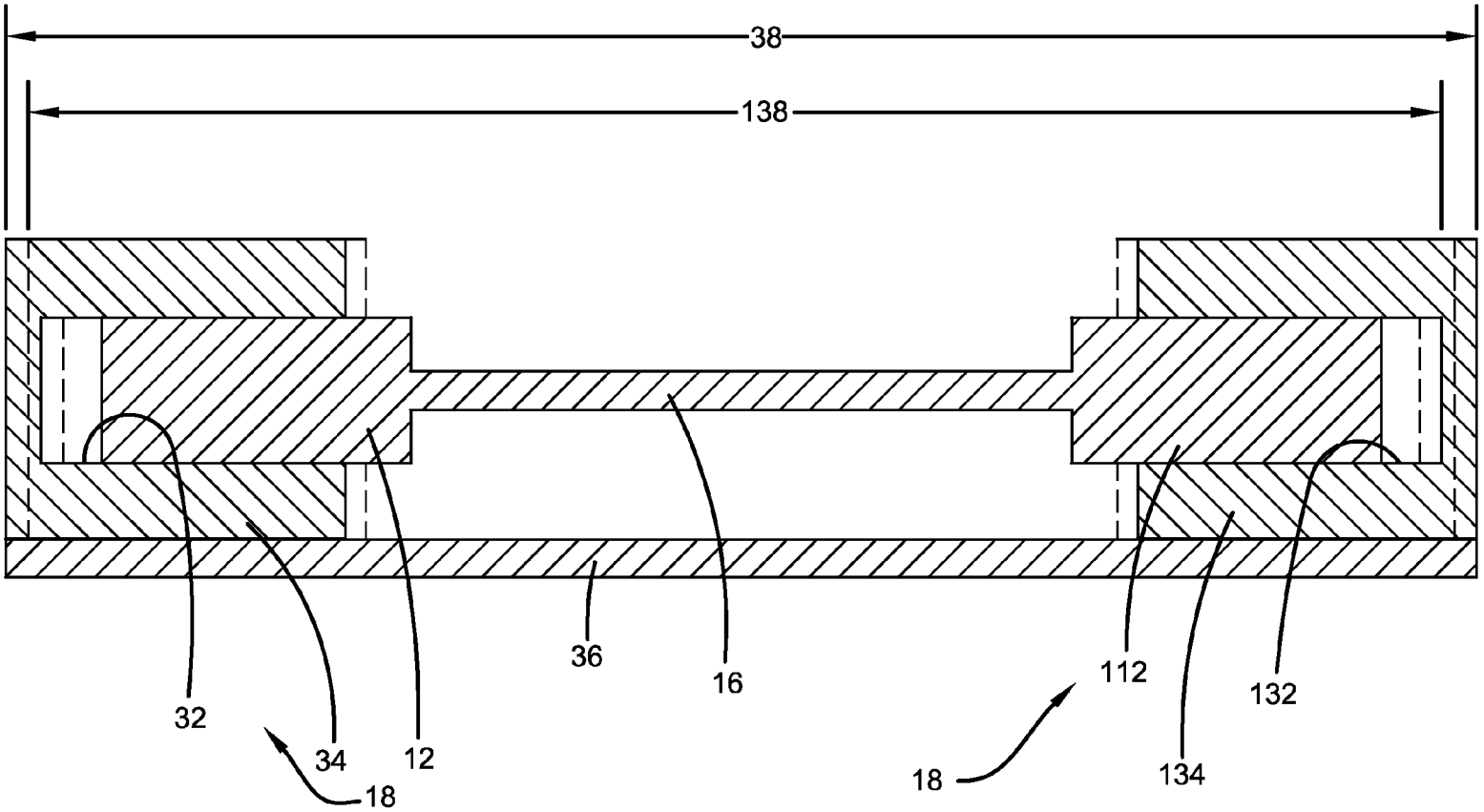
FIG. 6 is a cross-section taken through section lines 6-6 in FIG. 2.

The exemplary block 18 can includes a plurality of sub-blocks 34, 134. The sub-blocks 34, 134 can be non-integral and spaced from one another. In alternative embodiments of the present disclosure, the block 18 can be a unitary structure. Each of the sub-blocks 34, 134 can define at least two of the plurality of cylinders. The plurality of sub-blocks 34, 134 are adjustably positionable with respect to one another. As shown in FIG. 6, the sub-blocks 34, 134 can be releasibly mounted on a plate 36, such as with bolts or clamps. The sub-blocks 34, 134 can be releasibly mounted to a plurality of different locations or positioned on the plate 36 The sub-blocks 34, 134 can be mounted a distance apart referenced by 38 for a first period of operation. To change the compression ratio for a second period of operation, the sub-blocks 34, 134 can be moved closer together, a distance apart referenced by 138. The sub-blocks 34, 134 are shown in solid line for the first period of operation and in phantom for the second period of operation.

Referring again to FIG. 4, the fluid delivery system 20 can be operable to communicate air and combustible fuel to the cylinders. One or more valves 40 can be positioned to control flow from the fluid delivery system 20 to the respective cylinders. The pistons 12, 112, 212, 312 are operable to compress the air and combustible fuel. Gas-utilizing embodiments of the present disclosure can include sparking arrangements for each cylinder (not shown).

Embodiments of the present disclosure can also include a starter 42 to initiate operation of the engine.

The exemplary output shaft 22 can be driven in motion by motion of the pistons 12, 112, 212, 312. Motion is transmitted to the output shaft 22 from the pistons 12, 112, 212, 312 through the linking members 16, 116 and the cross member 14 in the first exemplary embodiment. The exemplary output shaft 22 extends beyond the sub-block 34 of the block 18 to a distal end 44 that can deliver movement for work and beyond the sub-block 134 of the block 18 to another distal end (not visible) that can deliver movement for work. The output of the output shaft 22 is referenced at arrow 46 in FIG. 4.

The output shaft 22 is limited to rectilinear movement. The output shaft 22 moves rectilinearly along its axis 324 (referenced in FIG. 3), back and forth, following the motion of the pistons 12, 112, 212, 312. In the first exemplary embodiment, the output shaft 22 is moveable rectilinearly along axis 324 which is parallel and spaced from both of the axes 124 and 224. In the first exemplary embodiment, the output shaft 22 passes through a bore 48 in the sub-block 34 and a bore 148 in the sub-block 134. The bores 48, 148 surround the output shaft 22 and limit the output shaft 22 to rectilinear movement along axis 324. The bores 48, 148 define a discontinuous bore, but the output shaft 122 could be mounted differently in other embodiment so as not to pass through any portion the block 18.

Figure 2:
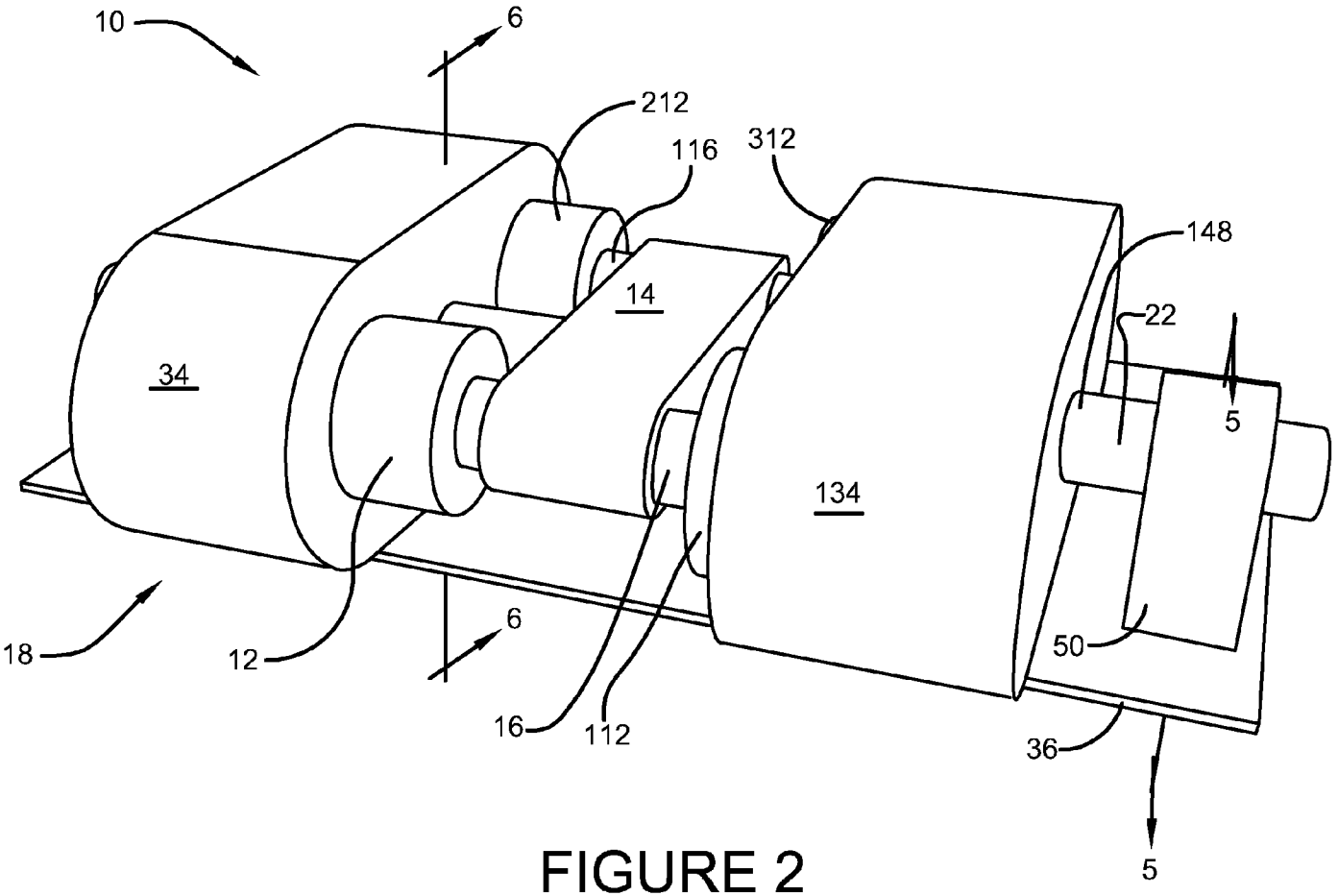
FIG. 2 is a second perspective view of the engine shown in FIG. 1.
Figure 3:
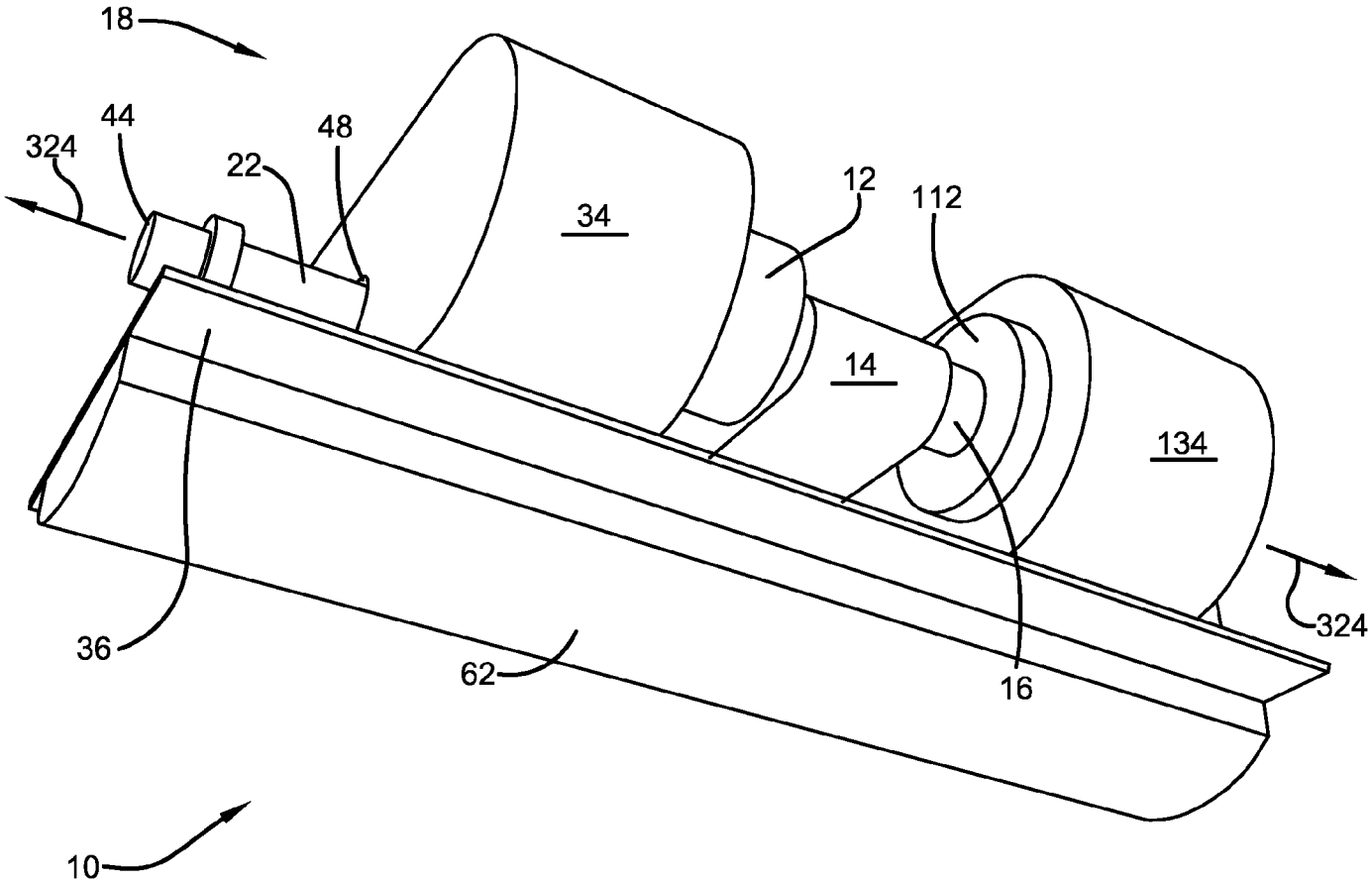
FIG. 3 is a third perspective view of the engine shown in FIGS. 1 and 2.
Figure 4:
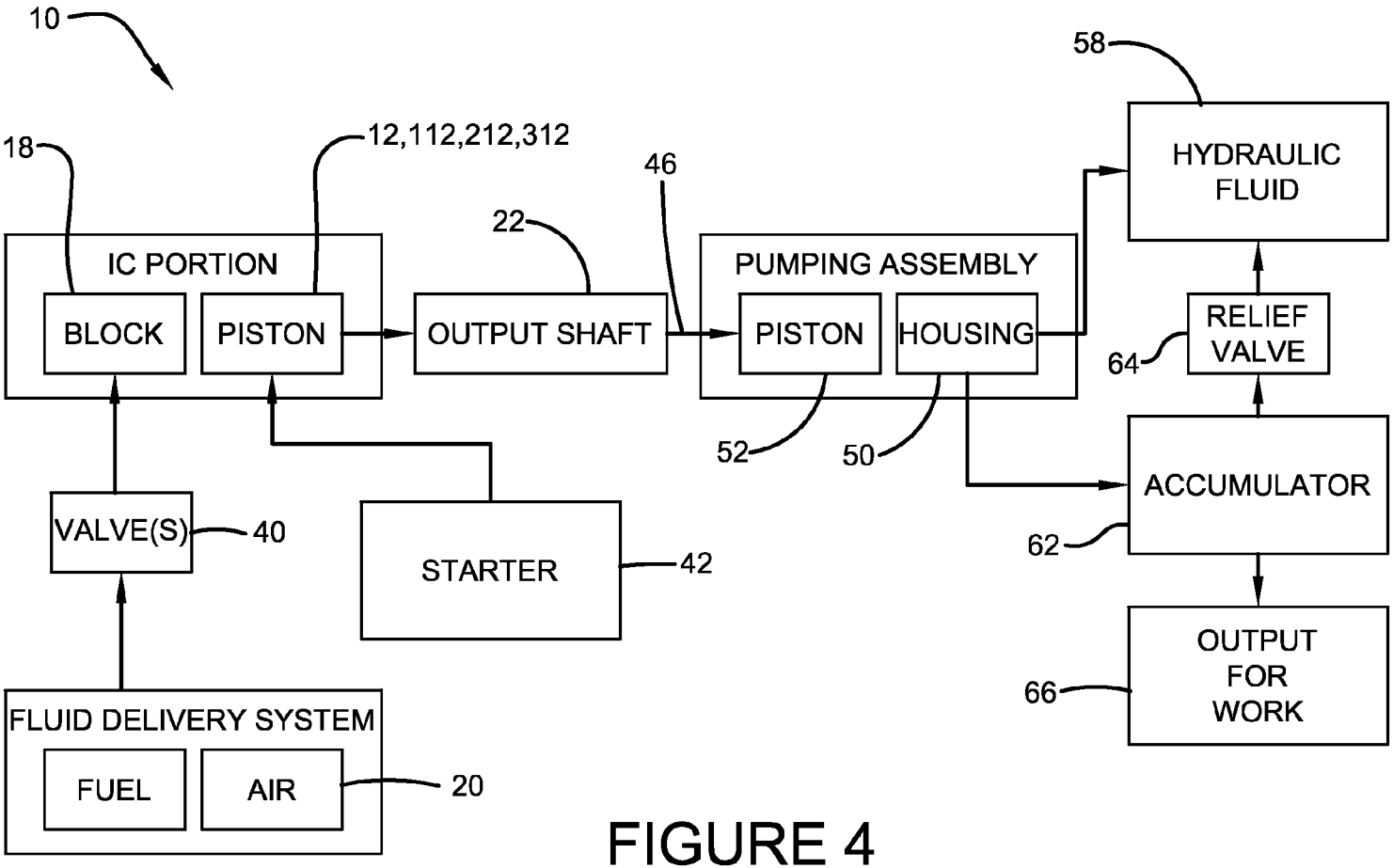
FIG. 4 is a schematic view of engine shown in FIGS. 1-3.

The first exemplary engine 10 can include a plurality of pumping assemblies. Each of the plurality of pumping assemblies can be driven in operation by the output shaft 22. Each pumping assembly can include a housing, such as housing 50 referenced in FIG. 2. Each pumping assembly can also include a secondary piston, such as piston 52 referenced in FIG. 1. In FIGS. 1-3, the housing on left-side of the drawing has been removed so that the piston 52 is visible; however, the exemplary embodiment includes pumping assemblies on each side of the block 18. The first distal end 44 of the output shaft 22 powers a first of the pumping assemblies and the second distal end 144 of the output shaft 22 powers a second of the pumping assemblies.

Figure 5:
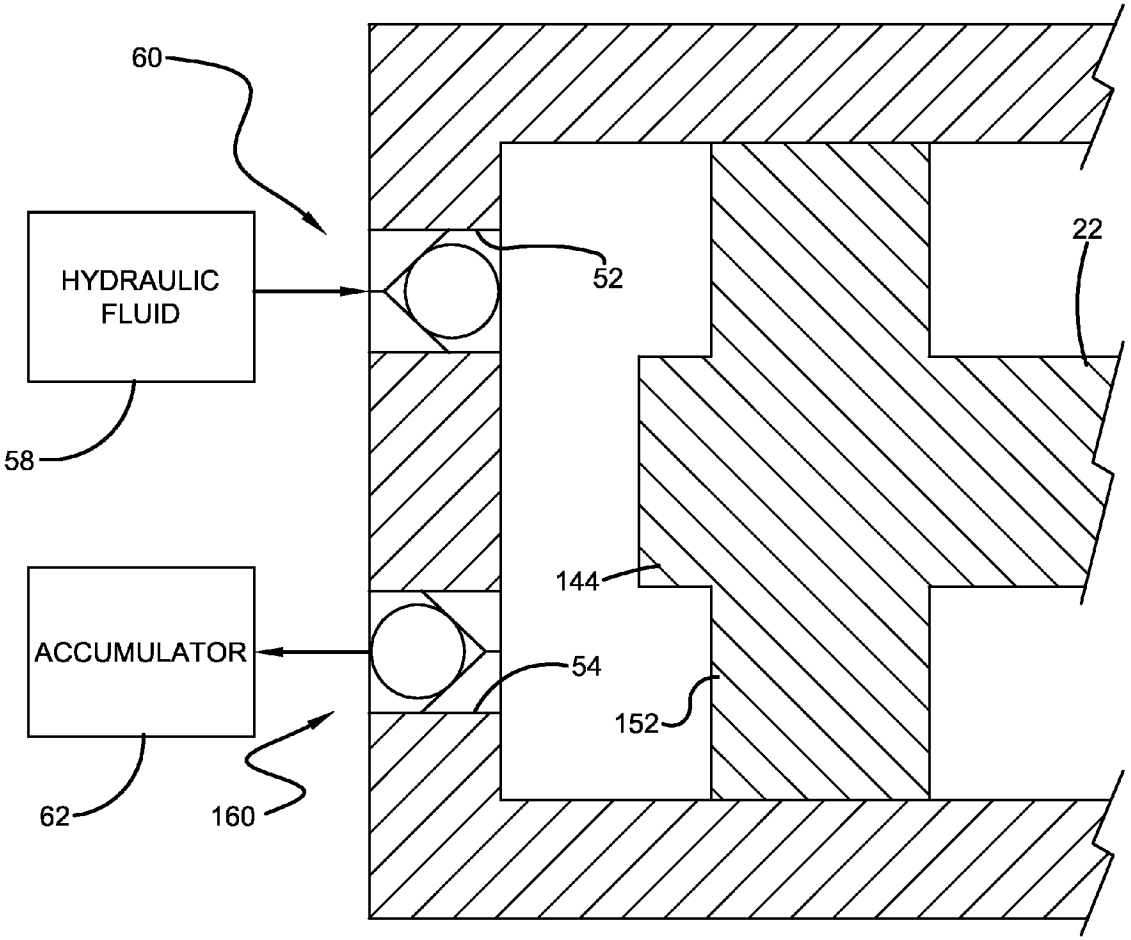
FIG. 5 is a partial cross-section taken through section lines 5-5 in FIG. 2.

FIG. 5 is a partial cross-section through the housing 50. The housing includes an inlet 54 and an outlet 56. The inlet 54 is in fluid communication with a source of hydraulic fluid, referenced at 58. The outlet 56 is in fluid communication with an accumulator, referenced at 62. A one-way check valve 60 (illustrated schematically) is positioned at the inlet 52. The valve 60 opens when the piston 152, mounted to the distal end 144, is moved away from the inlet 52 by the output shaft 22. The valve 60 closes when the piston 152 is moved toward the inlet 52 by the output shaft 22. A one-way check valve 160 (illustrated schematically) is positioned at the outlet 56. The valve 160 closes when the piston 152 is moved away from the outlet 56 by the output shaft 22. The valve 60 opens when the piston 152 is moved toward the outlet 56 by the output shaft 22. The accumulator 62 is operable to store fluid pressurized by the pumping assembly. The exemplary accumulator 62 is positioned proximate to the block 18, the plate 36 disposed between the block 18 and the accumulator 62. A relief valve 64 can be positioned between the accumulator 62 and the source 58 of hydraulic fluid to prevent over-pressurization of the accumulator 62 or damage to the pumping assemblies.

By directly driving a double-acting hydraulic pump (as described above), the engine 10 can deliver a high volume of high pressure oil with the minimum moving parts. The oil is sent to the hydraulic accumulator 62 to minimize pump pulsation and dump vibration and then to the component to be driven, such as a hydraulic motor, hydraulic arms, hydraulic hammers etc. Such output component is referenced at 66 in FIG. 4. The diameter of the pumping piston 52 can be around 40% of that of the primary piston and the same stroke.

Figure 7:
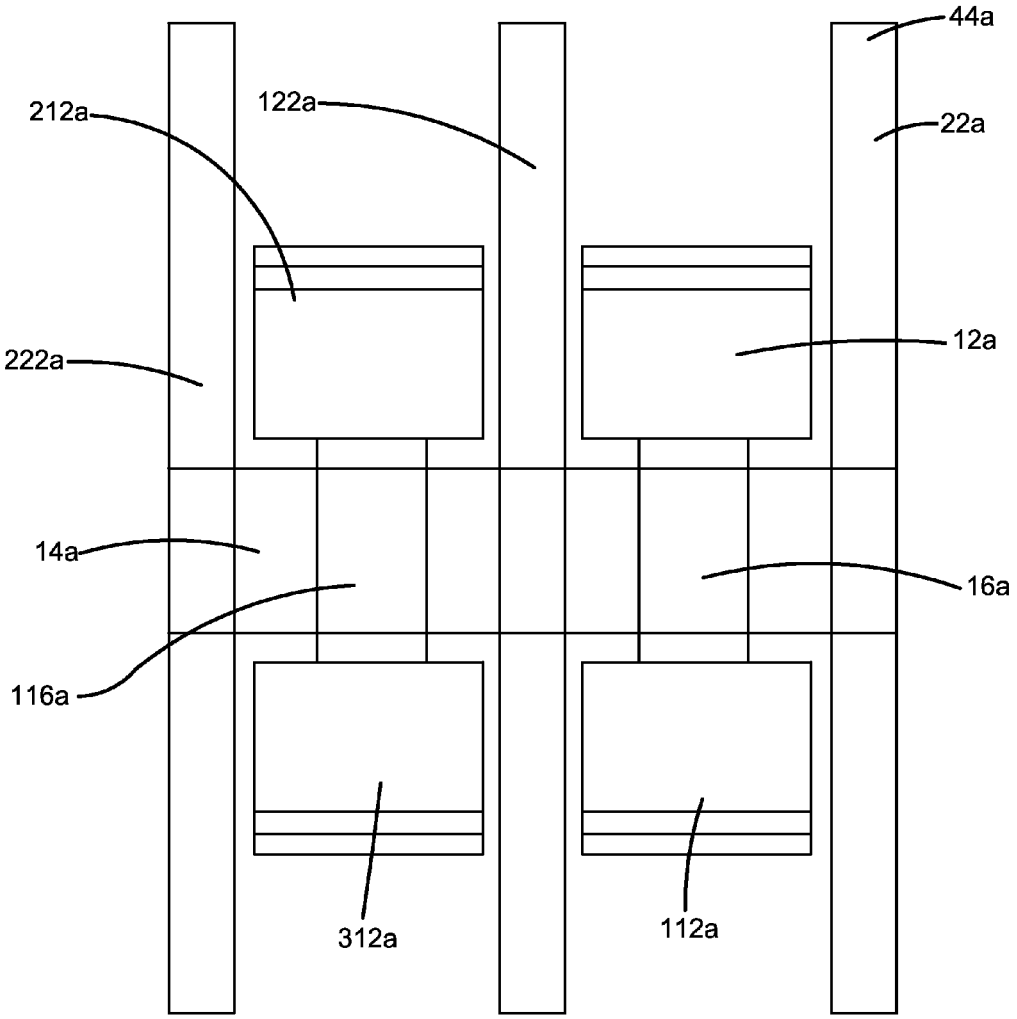
FIG. 7 is a plan view of a portion of an engine according to another exemplary embodiment of the present disclosure.

FIG. 7 is a plan view of a portion of an engine according to another exemplary embodiment of the present disclosure. A quartet of pistons 12*a*, 112*a*, 212*a*, 312*a* is shown interconnected with a cross member 14*a* and linking members 16*a*, 116*a*. A plurality of output shafts 22*a*, 122*a*, 222*a* are engaged with the linking members 16*a*, 116*a* through the cross member 14*a*. Each output shaft 22*a*, 122*a*, 222*a* defines a pair of distal ends for transmitting motion, such as distal end 44*a*. Thus, embodiments of the present disclosure can include more than output shaft.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or subcombinations that are disclosed herein as other present disclosures in other patent documents is hereby unconditionally reserved.

What is claimed is:

1. An engine comprising:

at least one piston;

a block defining at least one cylinder wherein said at least one piston is received in said at least one cylinder and wherein said at least one piston is operable to reciprocally move rectilinearly while positioned in said at least one cylinder;

a fluid delivery system operable to communicate air and combustible fuel to said at least one cylinder and wherein said at least one piston is operable to compress the air and combustible fuel;

an output shaft driven in motion by said at least one piston and extending beyond said block to a distal end and limited to rectilinear movement; and wherein said output shaft is moveable rectilinearly along a first axis and said piston is moveable rectilinearly along a second axis, wherein said first axis and said second axis are parallel and spaced from one another.

2. The engine of claim 1 wherein said output shaft extends through a bore defined by said block.

3. The engine of claim 1 further comprising:

a pumping assembly including a first housing with an inlet and an outlet, wherein said distal end of said output shaft is positioned within said first housing.

4. The engine of claim 3 further comprising:

an accumulator positioned to receive fluid pumped by said pumping assembly.

5. An engine comprising:

a plurality of primary pistons including a first primary piston and a second primary piston and a third primary piston and a fourth primary piston;

a cross member extending along a first axis between a first distal end and second distal end;

a first linking member mounted to said cross member at said first distal end and extending along a second axis between a third distal end and a fourth distal end and wherein said second axis is perpendicular to said first axis and wherein said first primary piston is mounted on said third distal end and said second primary piston is mounted on said fourth distal end;

a second linking member mounted to said cross member at said second distal end and extending along a third axis between a fifth distal end and a sixth distal end and wherein said third axis is perpendicular to said first axis and wherein said third primary piston is mounted on said fifth distal end and said fourth primary piston is mounted on said sixth distal end;

a block defining a plurality of cylinders including first cylinder and a second cylinder and a third cylinder and a fourth cylinder wherein said first primary piston is received in said first cylinder and said second primary piston is received in said second cylinder and said third primary piston is received in said third cylinder and said fourth primary piston is received in said fourth cylinder;

wherein said first primary piston and said second primary piston are operable to concurrently move in a first rectilinear direction while respectively positioned in said first cylinder and said second cylinder;

wherein said third primary piston and said fourth primary piston are operable to concurrently move in the first rectilinear direction while respectively positioned in said third cylinder and said fourth cylinder;

a fluid delivery system operable to communicate air and combustible fuel to said first cylinder and said second cylinder and said third cylinder and said fourth cylinder and wherein said first primary piston and said second primary piston and said third primary piston and said fourth primary piston are operable to compress the air and combustible fuel; and an output shaft extending beyond said block to a seventh distal end and engaged with said cross member and limited to rectilinear movement.

6. The engine of claim 5 wherein at least a portion of said output shaft is surrounded by said block.

7. The engine of claim 5 wherein said output shaft extends beyond said block in a first direction to said seventh distal end and beyond said block in a second direction opposite to said first direction to an eighth distal end.

8. The engine of claim 7 further comprising:

a first pumping assembly including a first housing with a first inlet and a first outlet and a first secondary piston positioned in said first housing, wherein said first secondary piston is mounted on said seventh distal end of said output shaft.

9. The engine of claim 8 further comprising:

a second pumping assembly including a second housing with a second inlet and a second outlet and a second secondary piston positioned in said second housing, wherein said second secondary piston is mounted on said eighth distal end of said output shaft.

10. The engine of claim 5 wherein said block includes a plurality of sub-blocks, each sub-block defining at least two of said plurality of cylinders.

* * * * *